US008226424B1

(12) United States Patent
Wang et al.

(10) Patent No.: US 8,226,424 B1
(45) Date of Patent: Jul. 24, 2012

(54) PLUG DEVICE WITH A CHANGEABLE ADAPTER

(75) Inventors: Tongt-Huei Wang, New Taipei (TW); Rosalia Kennedy, Concord, CA (US); Yu-Yi Wang, New Taipei (TW)

(73) Assignees: Tongt-Huei Wang, Concord, CA (US); Rosalia Kennedy, Concord, CA (US); Yu-Yi Wang, Concord, CA (US)

( * ) Notice: Subject to any disclaimer, the term of this patent is extended or adjusted under 35 U.S.C. 154(b) by 0 days.

(21) Appl. No.: 13/068,985

(22) Filed: May 25, 2011

(51) Int. Cl.
*H01R 29/00* (2006.01)

(52) U.S. Cl. ..... 439/172

(58) Field of Classification Search ..... 439/172, 439/620.21, 620.22, 76.1, 173, 518
See application file for complete search history.

(56) References Cited

U.S. PATENT DOCUMENTS 5,775,921 A * 7/1998 Chou ..... 439/21
6,089,921 A * 7/2000 Chou ..... 439/640
7,168,969 B1 * 1/2007 Wang ..... 439/173
7,381,059 B2 * 6/2008 Wong ..... 439/22
7,462,074 B1 * 12/2008 Devlin et al. ..... 439/640
7,575,436 B1 * 8/2009 Devlin et al. ..... 439/21
7,597,570 B2 * 10/2009 So ..... 439/172
7,946,868 B1 * 5/2011 Chen ..... 439/173
8,079,877 B1 * 12/2011 Lai et al. ..... 439/655
2003/0211767 A1 * 11/2003 Philips et al. ..... 439/170
2005/0176281 A1 * 8/2005 Zhuge ..... 439/173
2011/0021040 A1 * 1/2011 Garb et al. ..... 439/13

* cited by examiner

*Primary Examiner* — Amy Cohen Johnson
*Assistant Examiner* — Vladimir Imas

(57) ABSTRACT

A plug device with a changeable adapter has a base and an adapter. The base has a transformer circuit and a first connecting component. The adapter is detachably mounted on the base and has two prongs and a second connecting component selectively connected to the first connecting component of the base. When a user goes on a trip abroad, the user is capable of replacing the adapter to fit sockets of a specific country and to supply electrical power to electronic devices that the user carries along.

12 Claims, 20 Drawing Sheets

PLUG DEVICE WITH A CHANGEABLE ADAPTER

BACKGROUND OF THE INVENTION

1. Field of the Invention

The present invention relates to a plug device, especially to a plug device with a changeable adapter to comply with different electrical socket standards in different countries.

2. Description of the Prior Art(s)

With the economic development, business among countries has become more and more frequent. Businessmen are often on a business trip across different countries. However, electrical sockets differ by countries. For example, the electrical sockets in USA, United Kingdom, Australia and continental Europe are all different from one another. Consequently, electrical plugs for the electrical sockets also differ by countries. Whenever a businessman goes on the business trip abroad and wants to charge electronic devices carried with him, such as mobile phone, personal digital assistant, laptop and the like, the businessman has to prepare a transformer or a battery charger that has plugs fitting in the specific socket of the country and preparing different transformers or battery chargers for different countries is troublesome.

To overcome the shortcomings, the present invention provides a plug device with a changeable adapter to mitigate or obviate the aforementioned problems.

SUMMARY OF THE INVENTION

The main objective of the present invention is to provide a plug device with a changeable adapter. The plug device with a changeable adapter has a base and an adapter. The base has a transformer circuit and a first connecting component. The adapter is detachably mounted on the base and has two prongs and a second connecting component selectively connected to the first connecting component of the base. When a user goes on a trip abroad, the user is capable of replacing the adapter to fit sockets of a specific country and to supply electrical power to electronic devices that the user carries along.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
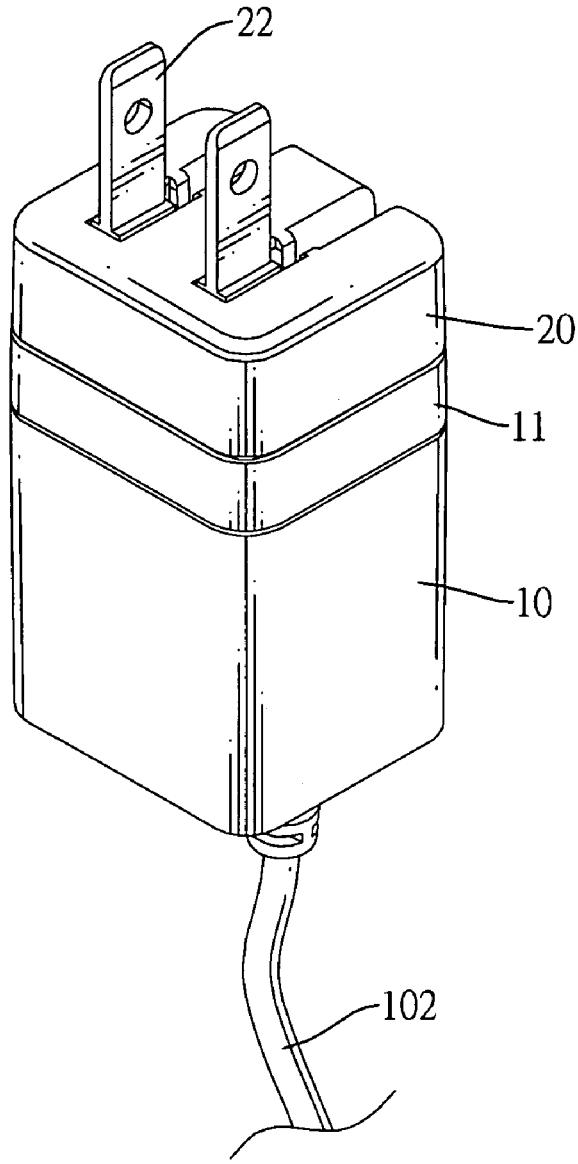
FIG. 1 is a perspective view of a first embodiment of a plug device with a changeable adapter in accordance with the present invention.
Figure 2:
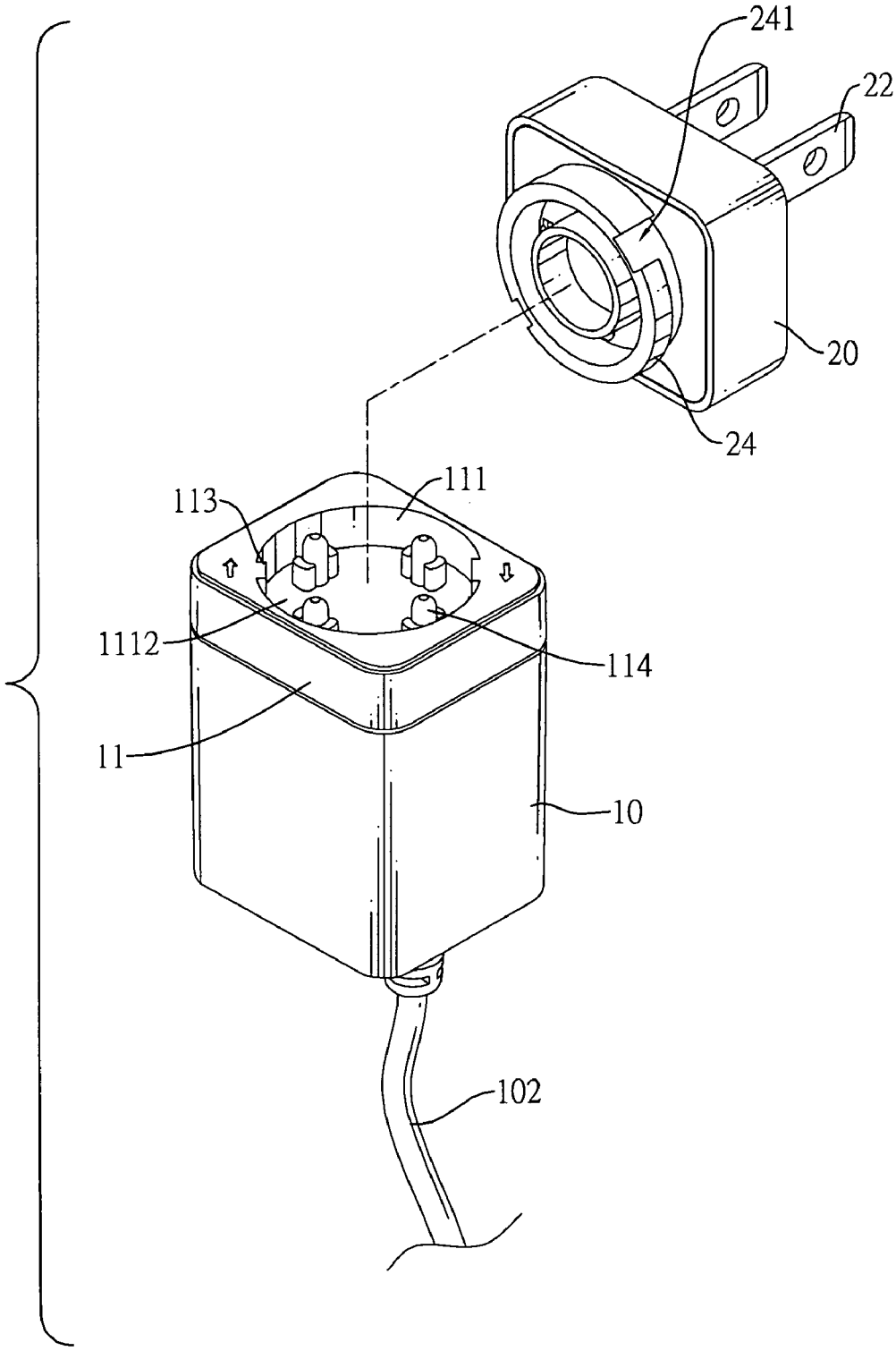
FIG. 2 is an exploded perspective view of the plug device in FIG. 1.
Figure 8:
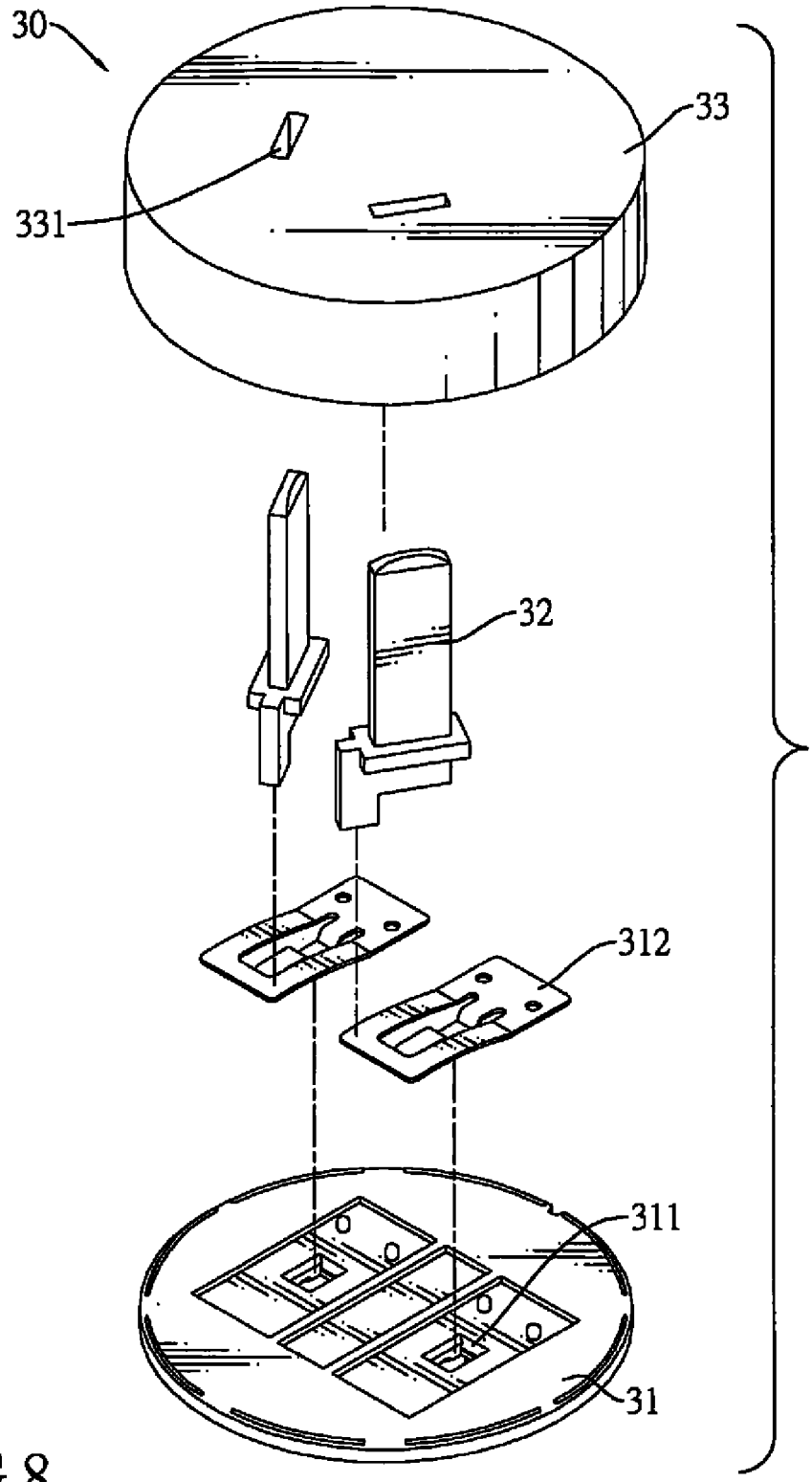
FIG. 8 is a perspective view of a second embodiment of a plug device with a changeable adapter in accordance with the present invention.
Figure 10:
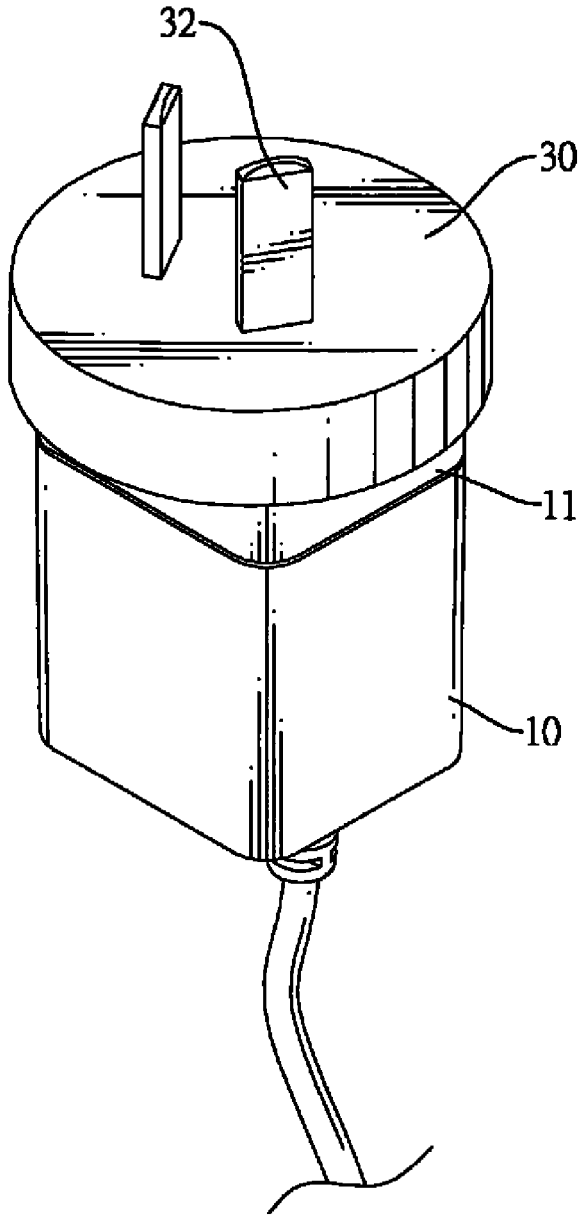
FIG. 10 is an exploded perspective view of an adapter of the plug device in FIG. 8.
Figure 12:
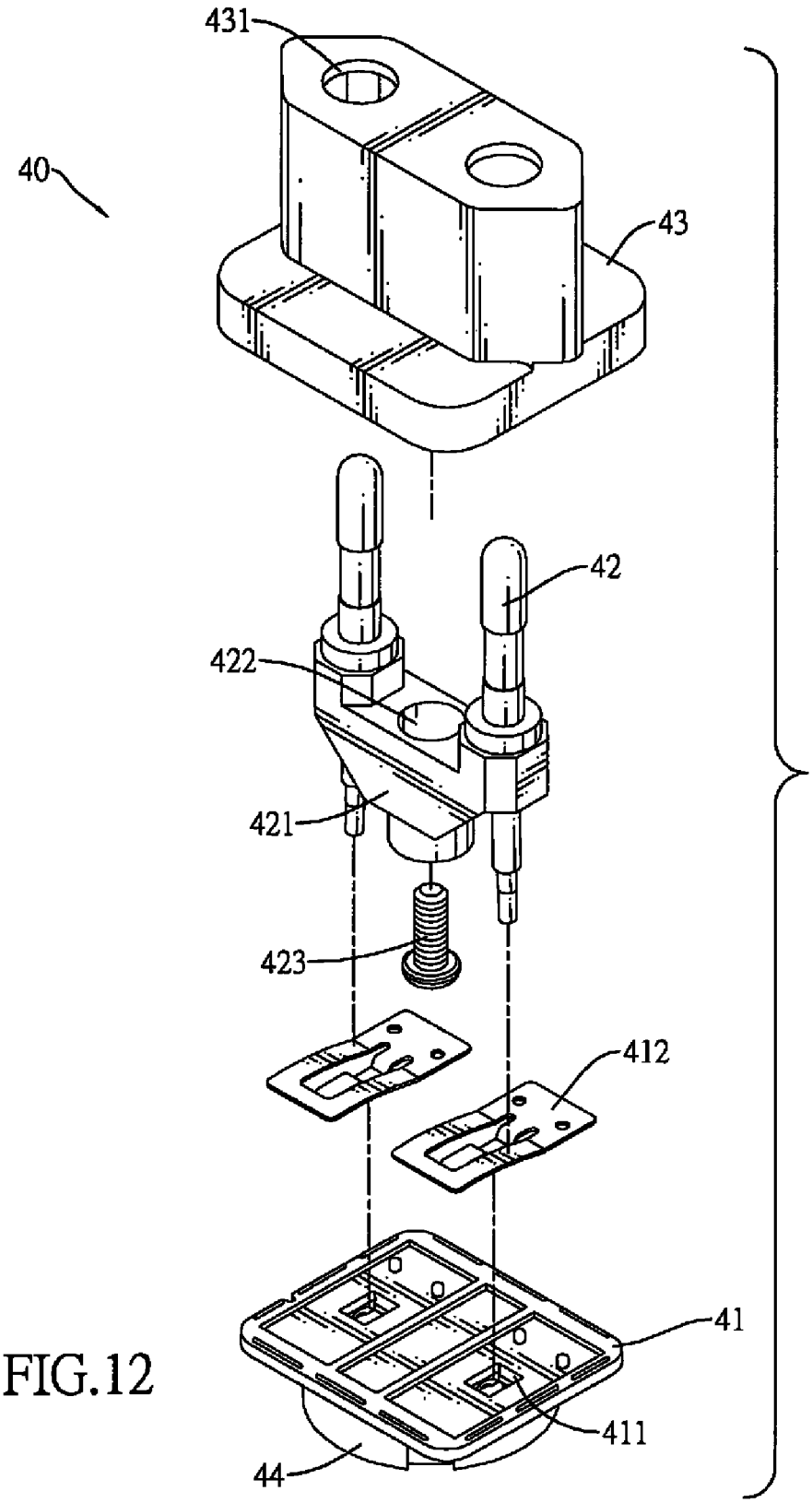
FIG. 12 is a perspective view of a third embodiment of a plug device with a changeable adapter in accordance with the present invention.
Figure 14:
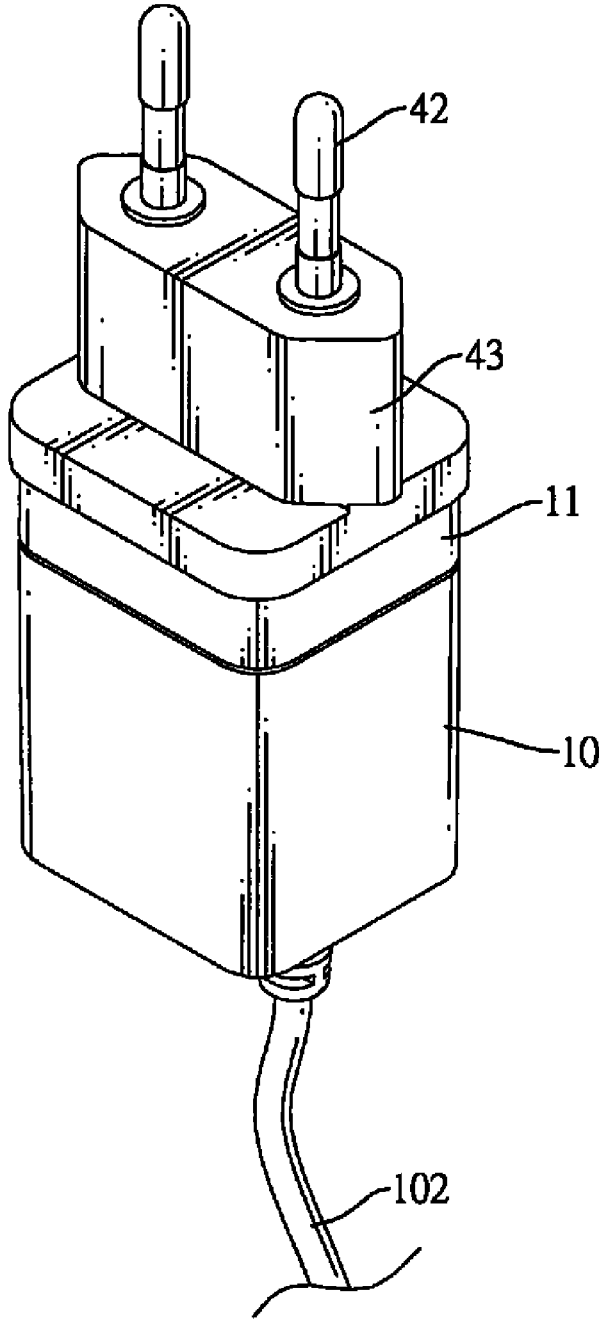
FIG. 14 is an exploded perspective view of an adapter of the plug device in FIG. 12.
Figure 16:
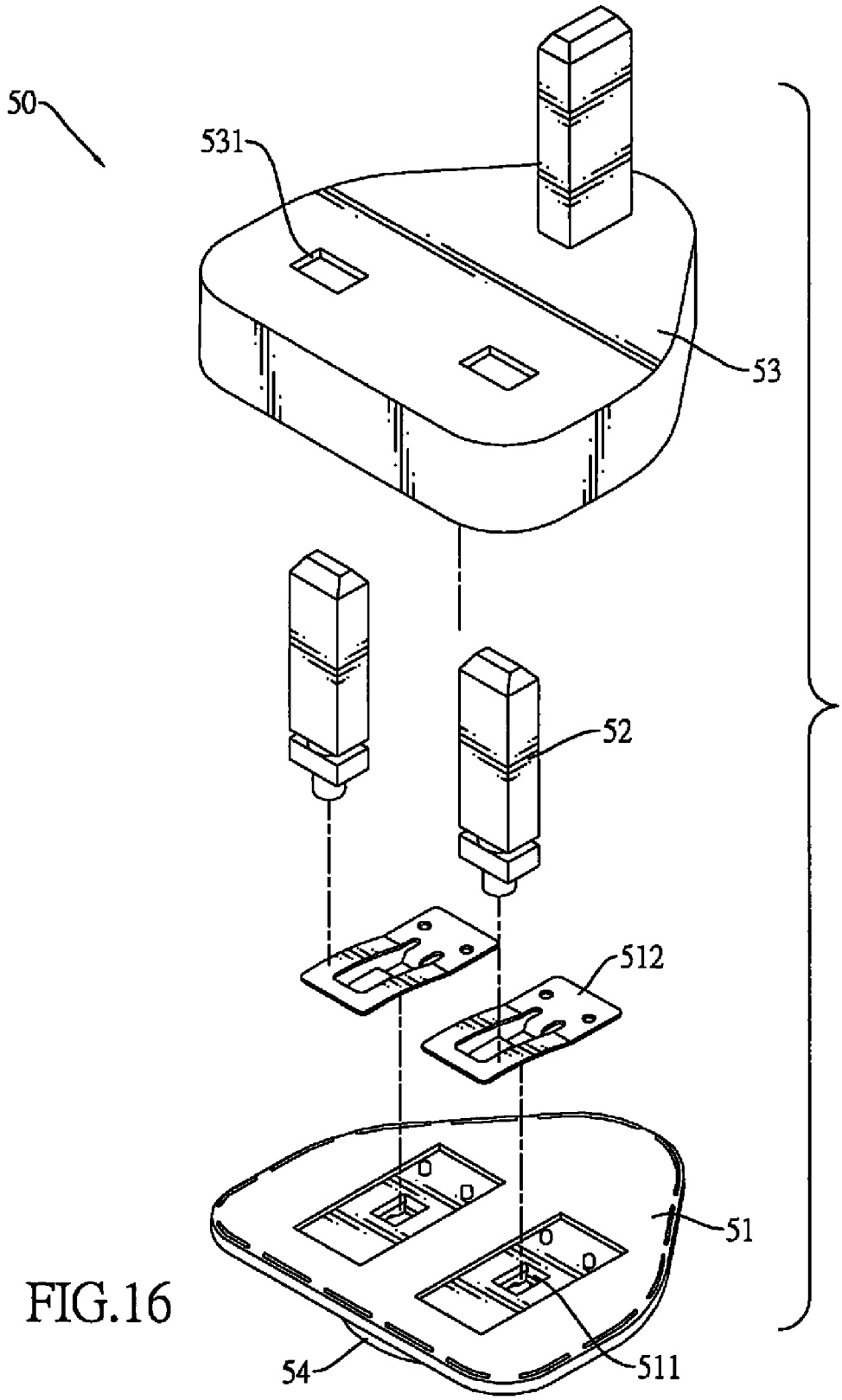
FIG. 16 is a perspective view of a fourth embodiment of a plug device with a changeable adapter in accordance with the present invention.
Figure 18:
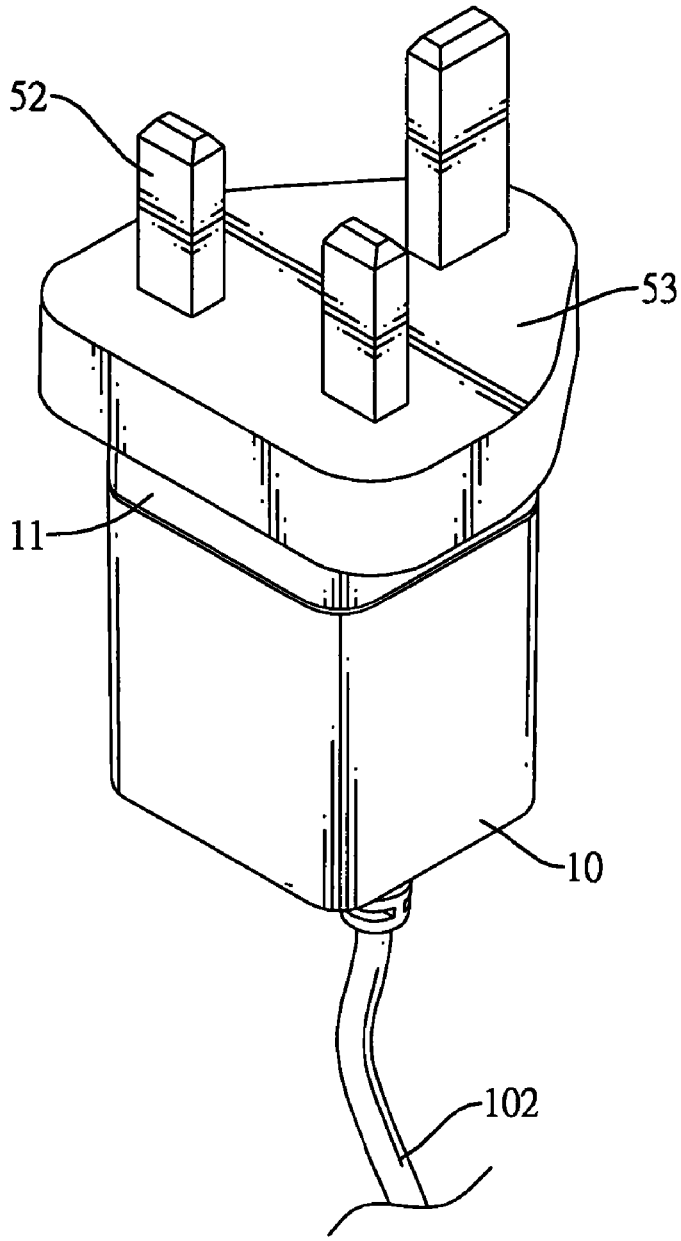
FIG. 18 is an exploded perspective view of an adapter of the plug device in FIG. 16.
Figure 20:
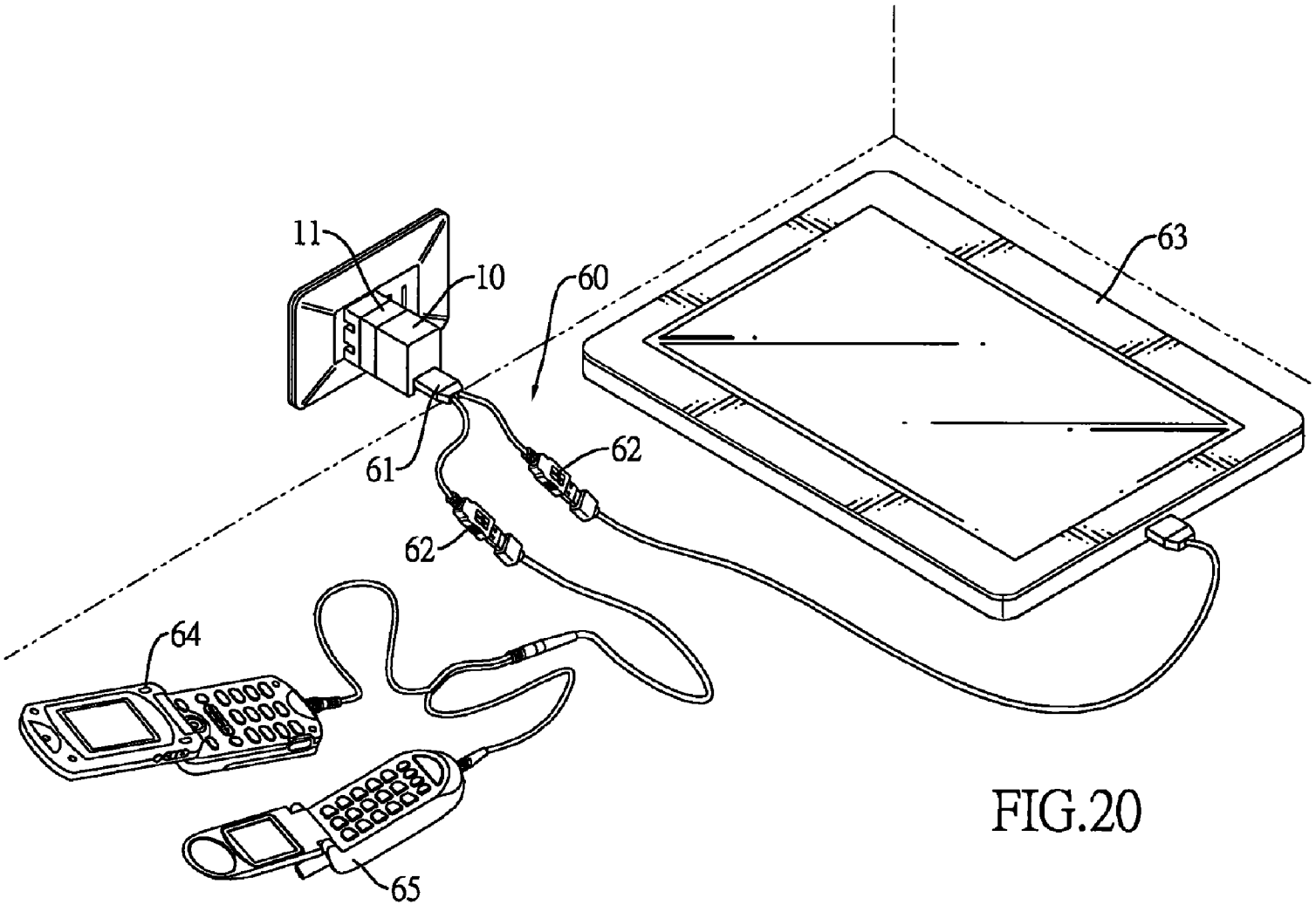
FIG. 20 is an operational perspective view of a fifth embodiment of a plug device with a changeable adapter in accordance with the present invention.

With reference to FIGS. 1, 2, 8, 10, 12, 14, 16, 18 and 20, a plug device with a changeable adapter in accordance with the present invention comprises a base 10, an adapter 20, 30, 40, 50 and a power supply 102.

Figure 3:
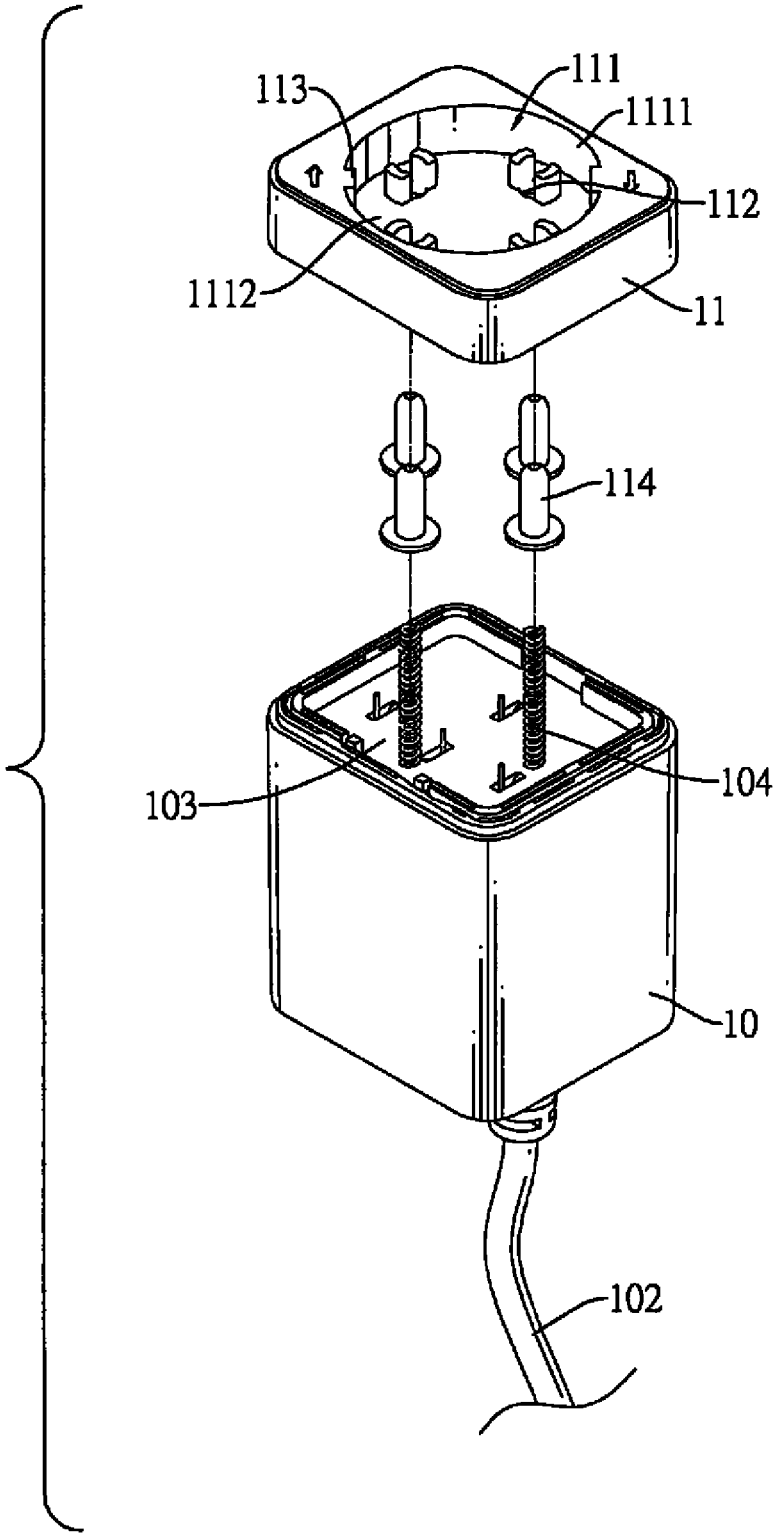
FIG. 3 is an exploded perspective view of a base of the plug device in FIG. 1.
Figure 4:
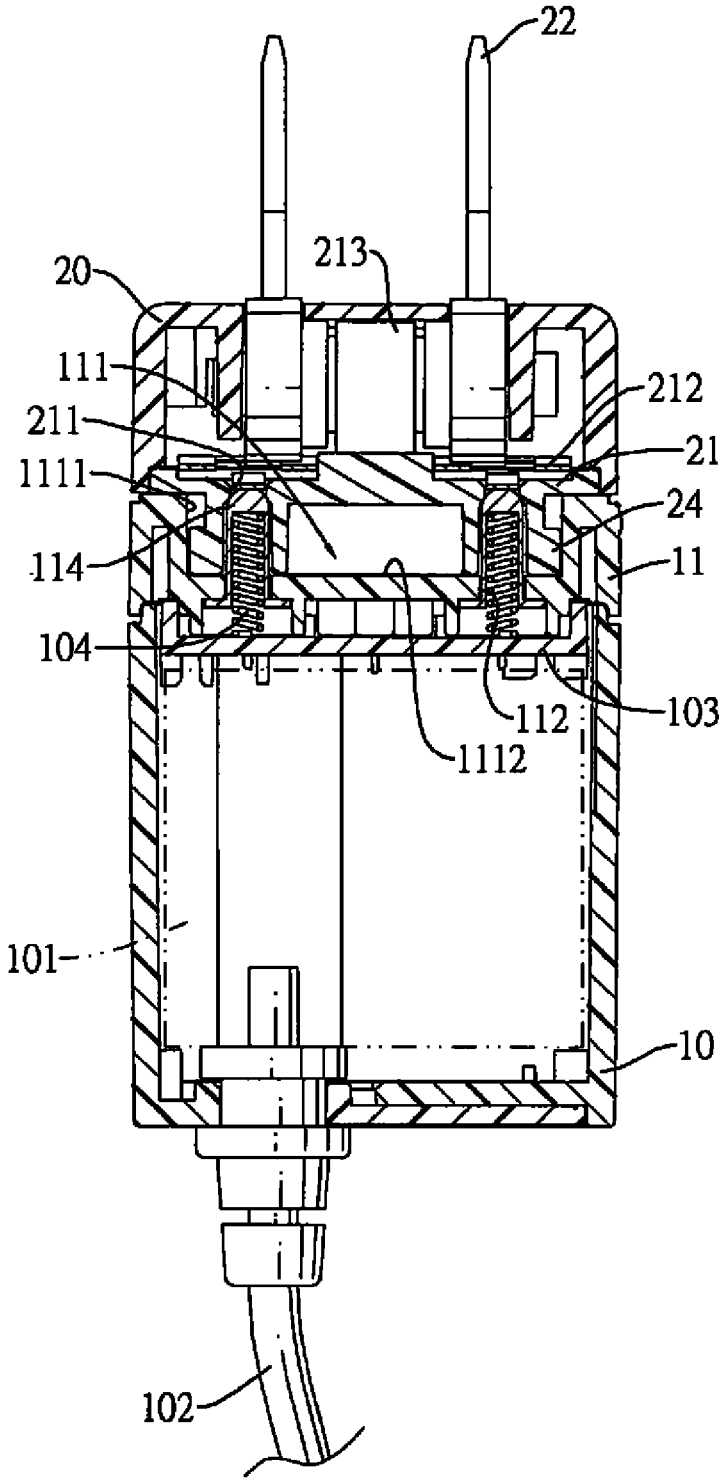
FIG. 4 is a side view in partial section of the plug device in FIG. 1.
Figure 9:
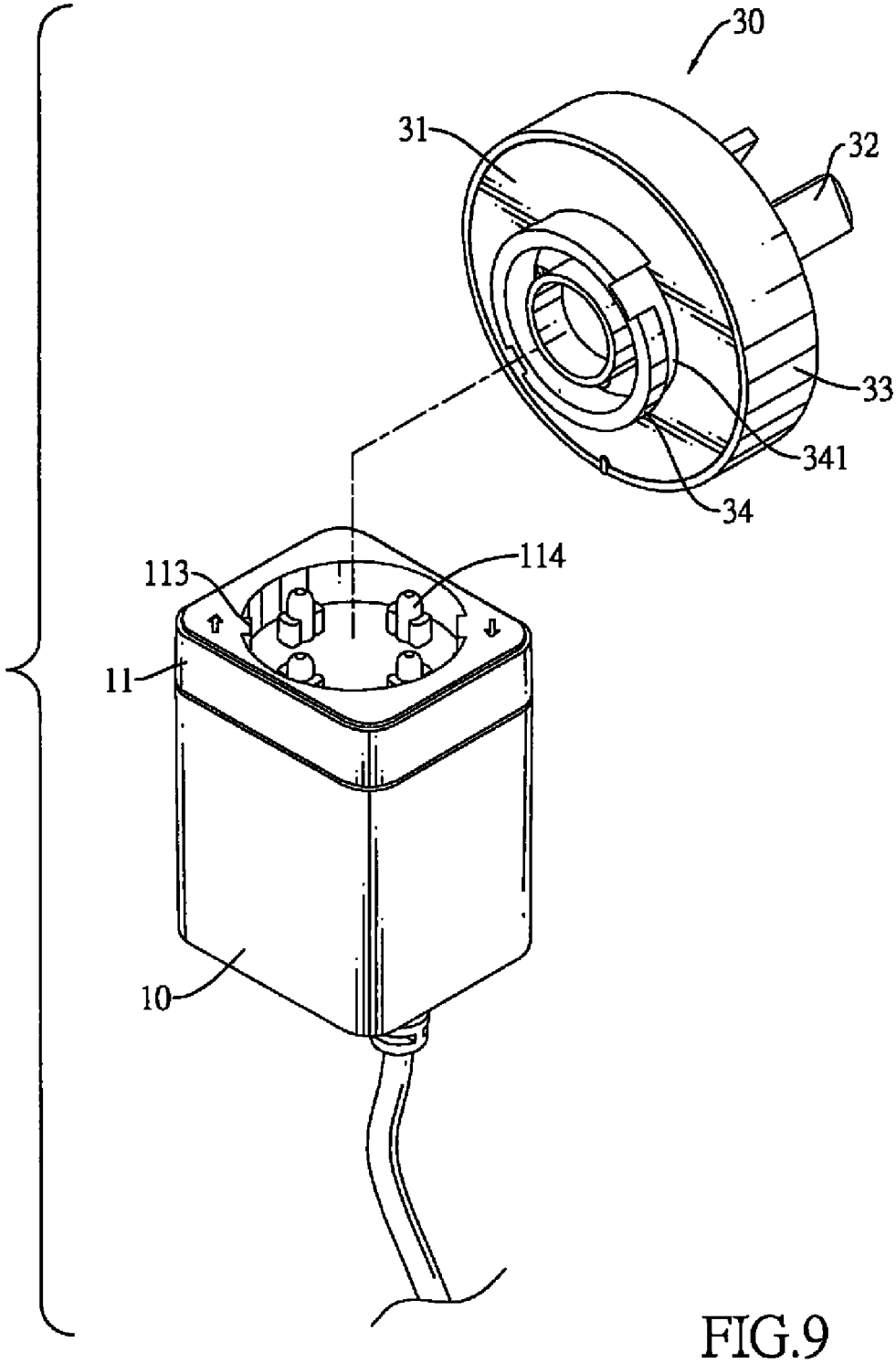
FIG. 9 is an exploded perspective view of the plug device in FIG. 8.
Figure 11:
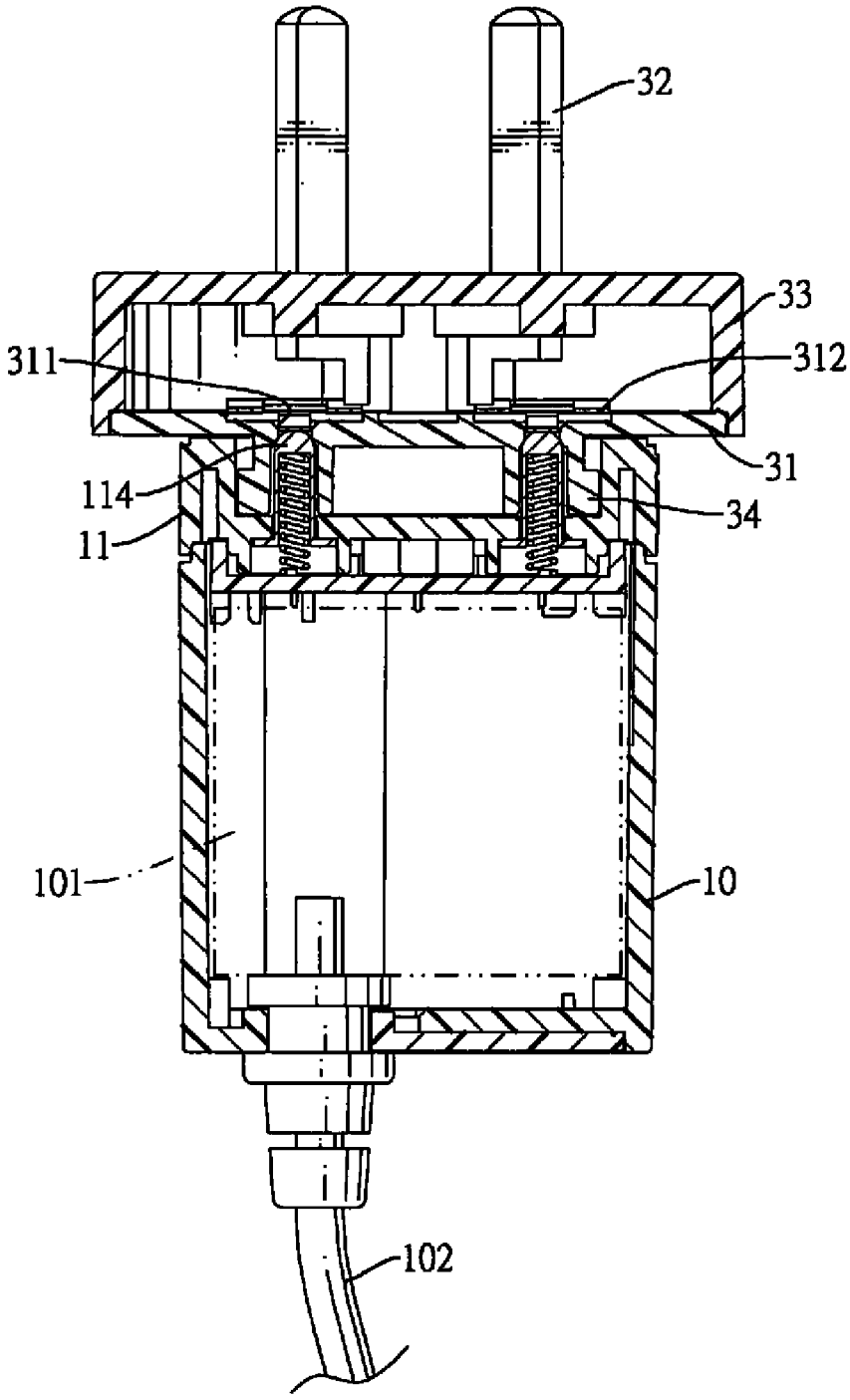
FIG. 11 is a side view in partial section of the plug device in FIG. 8.
Figure 13:
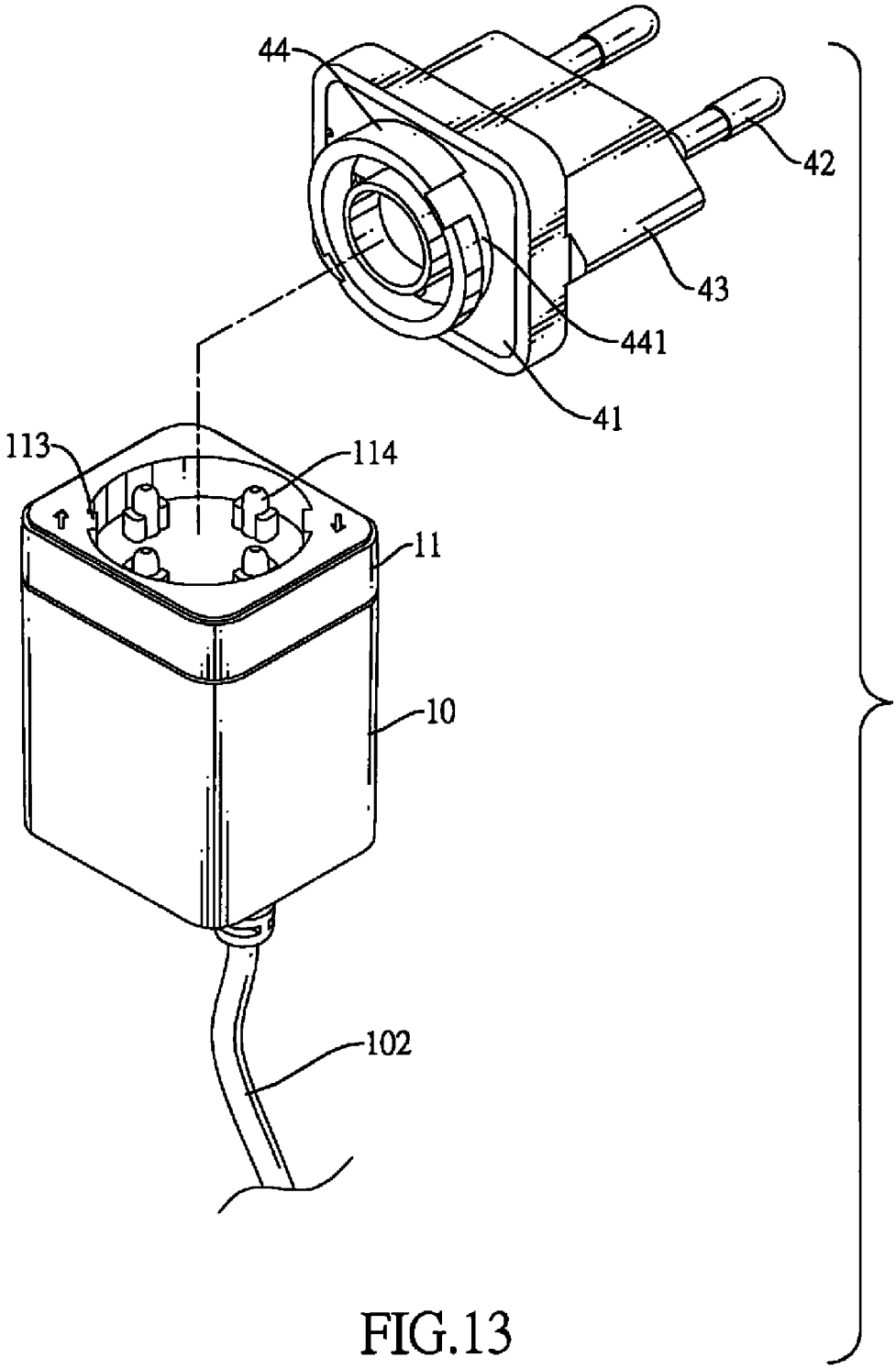
FIG. 13 is an exploded perspective view of the plug device in FIG. 12.
Figure 15:
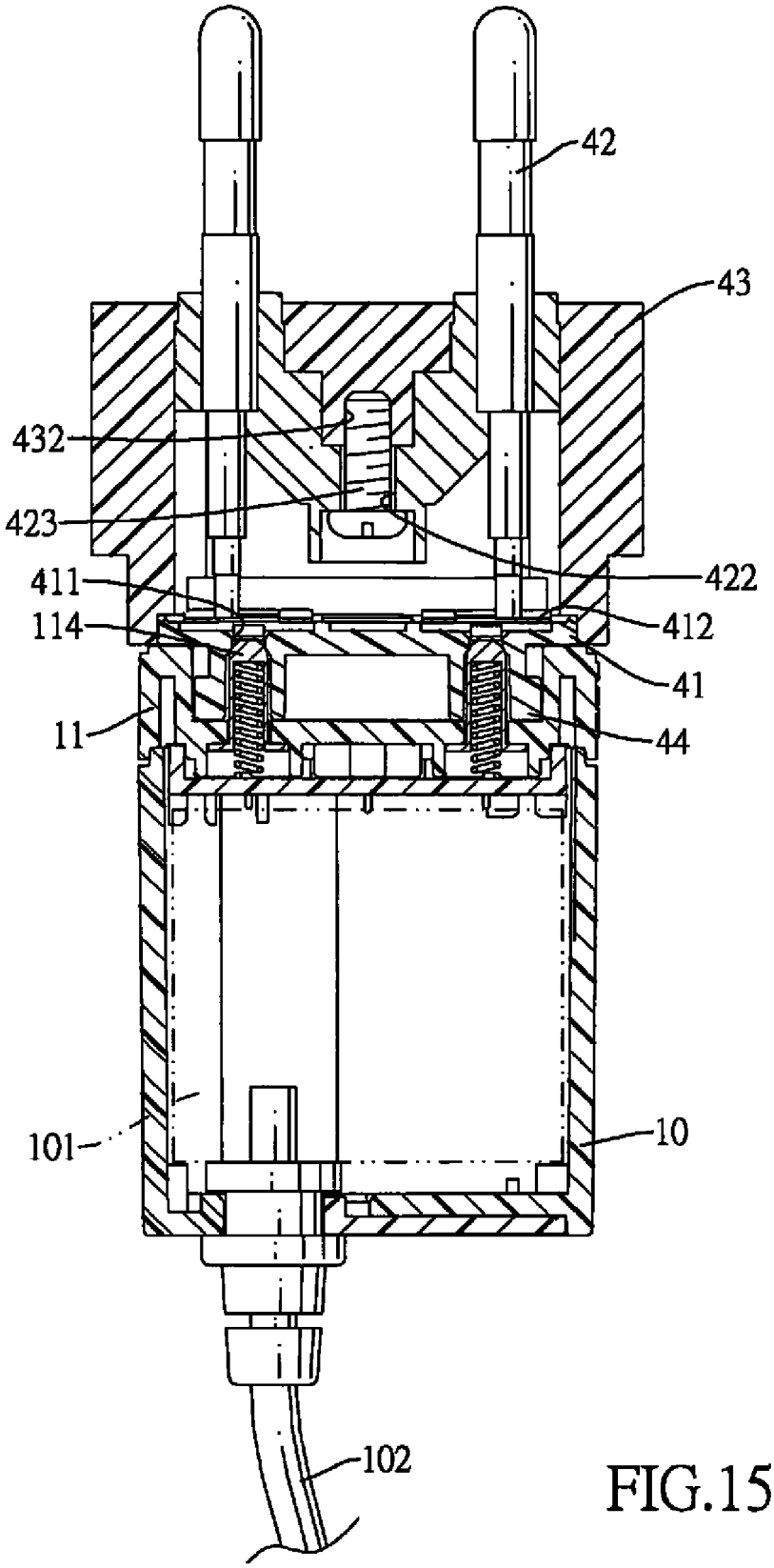
FIG. 15 is a side view in partial section of the plug device in FIG. 12.
Figure 17:
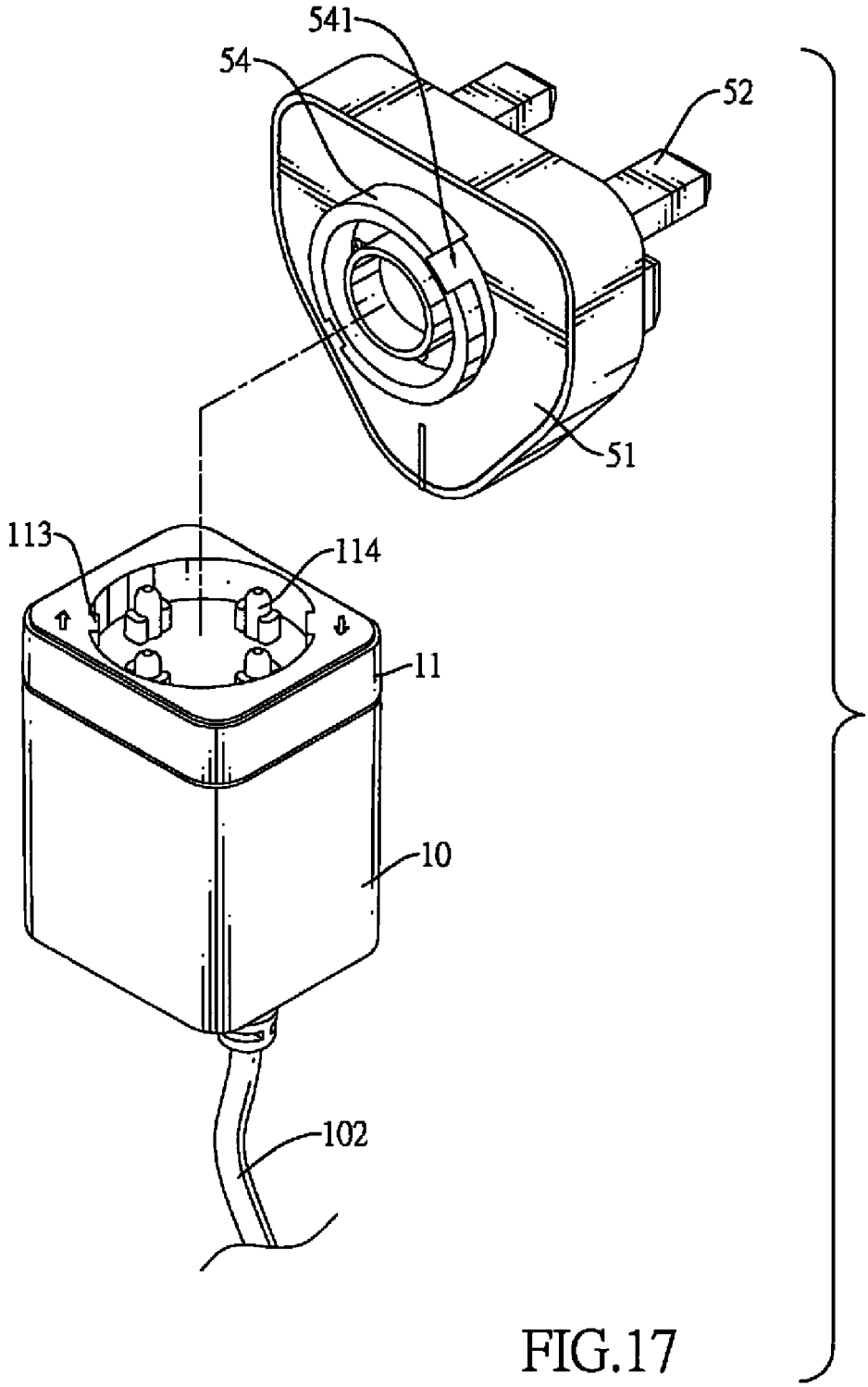
FIG. 17 is an exploded perspective view of the plug device in FIG. 16.
Figure 19:
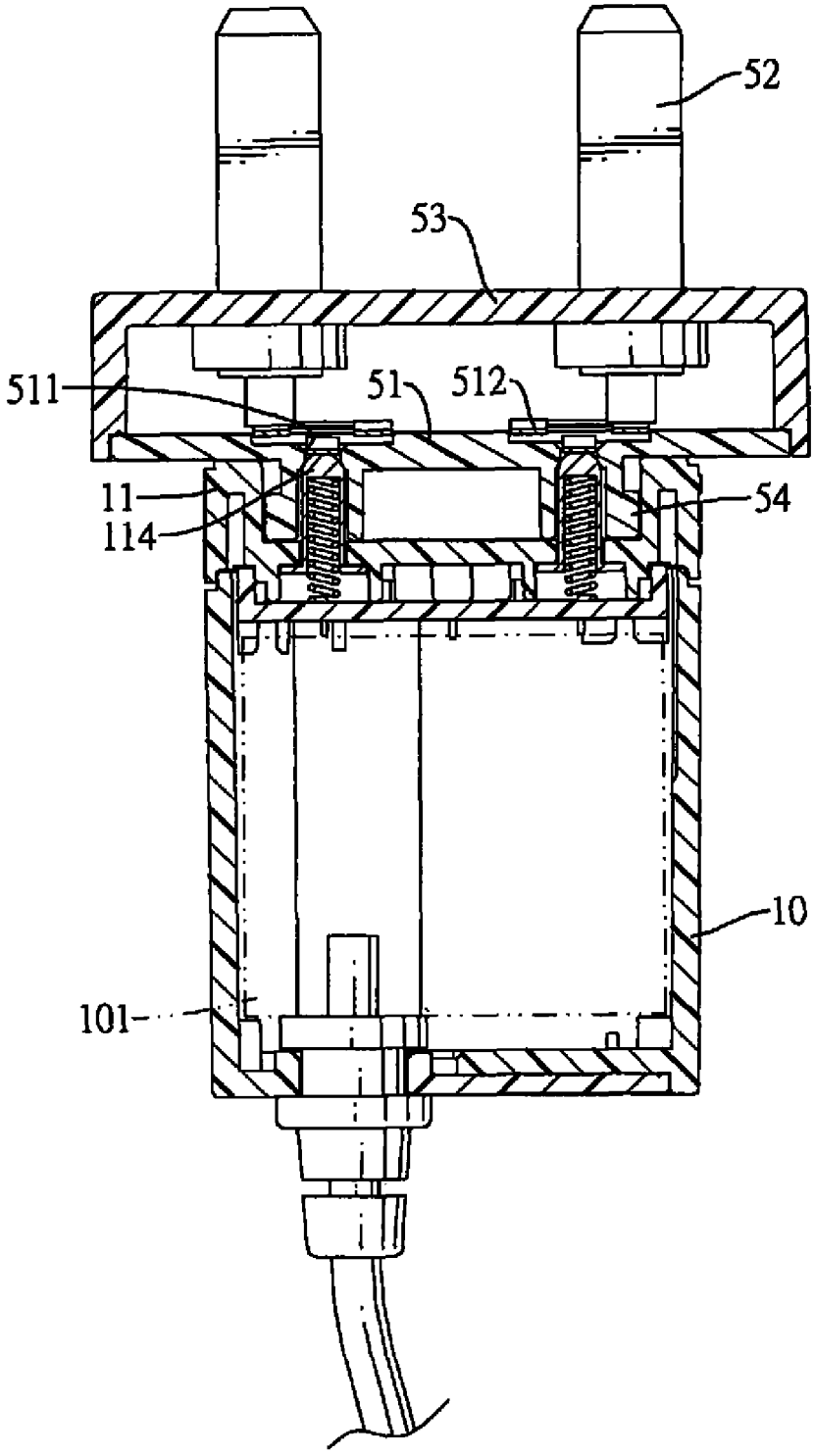
FIG. 19 is a side view in partial section of the plug device in FIG. 16.

With further reference to FIGS. 3, 4, 9, 11, 13, 15, 17 and 19, the base 10 is hollow and rectangular and has a transformer circuit 101, an inner cover 103, at least two conductive resilient elements 104, a first connecting component 11 and at least two conductive connectors 114.

The transformer circuit 101 is mounted in the base 10. The inner cover 103 is mounted on a top of the base 10. The at least two conductive resilient elements 104 are mounted through the inner cover 103 and electrically connected to the transformer circuit 101 of the base 10.

The first connecting component 11 is disposed on the top of the base 10 over the inner cover 103 and has a mounting recess 111, an inner peripheral surface 1111, a bottom 1112, at least one positioning protrusion 113 and at least two through holes 112. The mounting recess 111 is formed in a top of the first connecting component 11. The inner peripheral surface 1111 is defined around the mounting recess 111. The bottom 1112 is defined in the mounting recess 111. The at least one positioning protrusion 113 is formed on the inner peripheral surface 1111 and is spaced out from the bottom 1112. The at least two through holes 112 are separately formed through the bottom 1112.

The at least two conductive connectors 114 are slidably mounted through the bottom 1112 of the first connecting component 11, are respectively mounted slidably through the at least two through holes 112 of the first connecting component 11, respectively abut the at least two conductive resilient elements 104 and are electrically connected to the transformer circuit 101 through the at least two conductive resilient elements 104. Preferably, each of the at least two conductive connectors 114 is tubular and has an open end and a closed end. The open end of the conductive connector 114 corresponds to the inner cover 103. The at least two conductive resilient elements 104 are respectively mounted in the at least two conductive connectors 114 and abut the closed end of the at least two conductive connectors 114.

Figure 5:
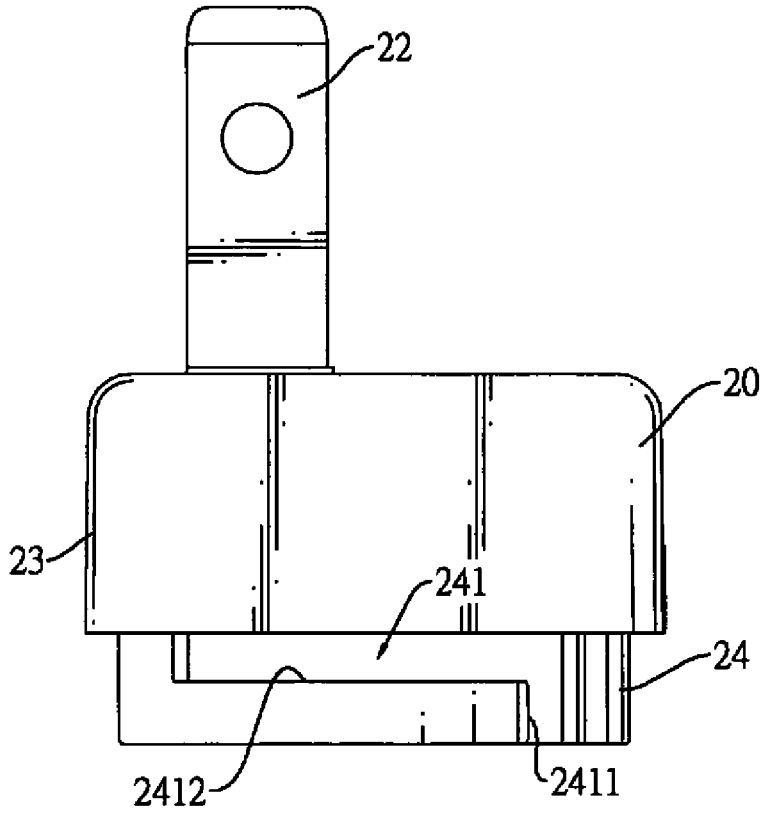
FIG. 5 is a side view of an adapter of the plug device in FIG. 1.
Figure 6:
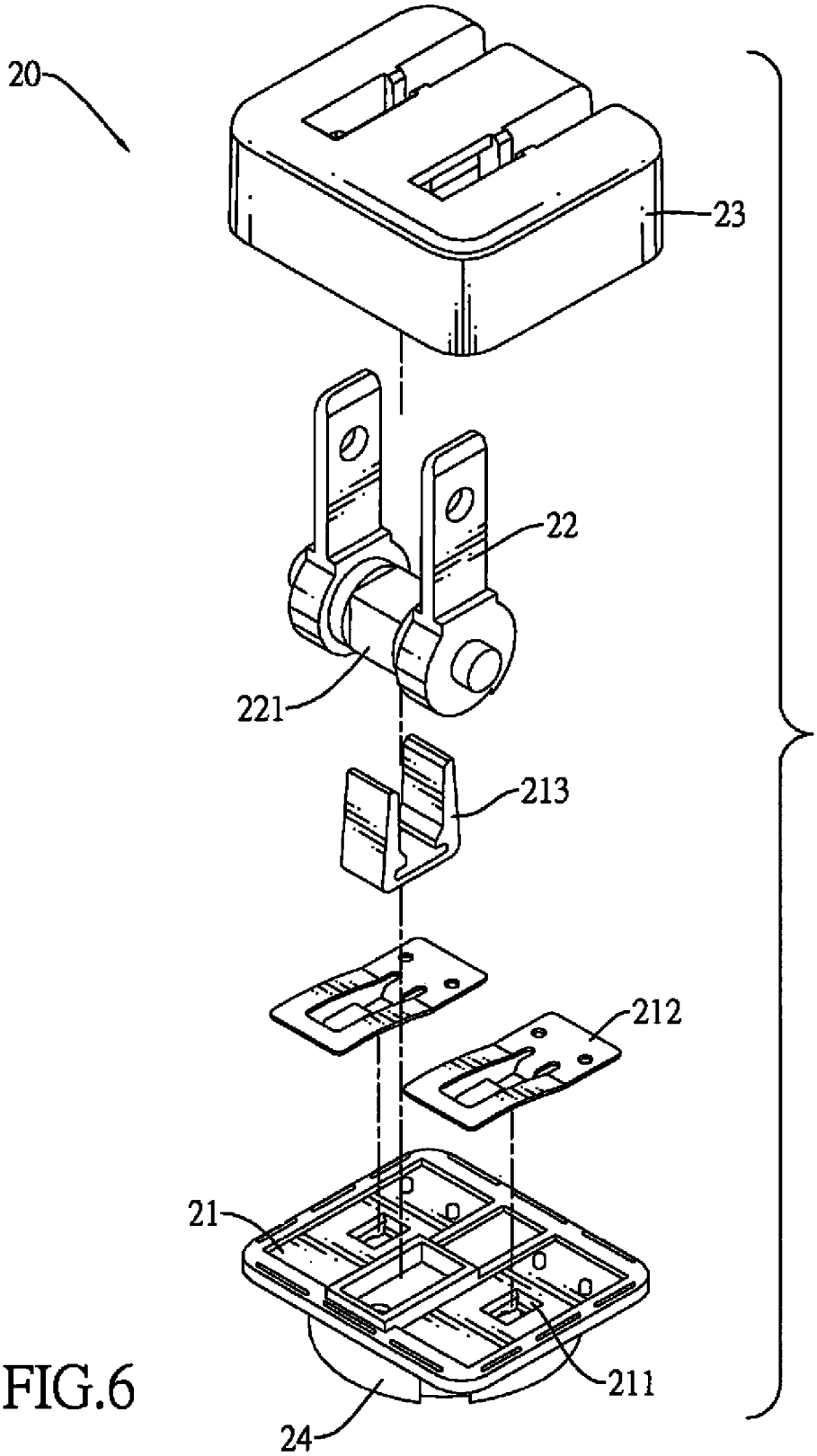
FIG. 6 is an exploded perspective view of the adapter of the plug device in FIG. 5.
Figure 7:
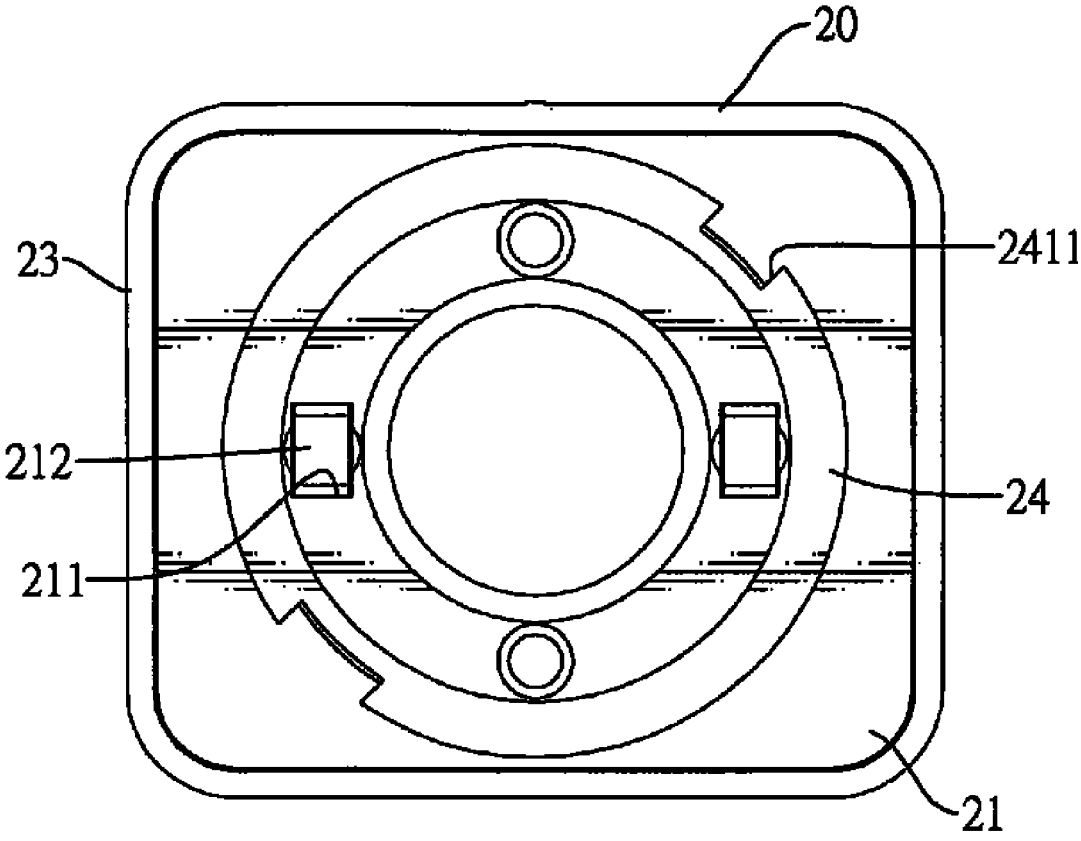
FIG. 7 is a bottom view of the adapter of the plug device in FIG. 5.

With further reference to FIGS. 4 to 7, the adapter 20, 30, 40, 50 is detachably mounted on the base 10 and has a housing, at least two conductive sheets 212, 312, 412, 512, at least two prongs 22, 32, 42, 52 and a second connecting component 24, 34, 44, 54.

The housing has a mounting panel 21, 31, 41, 51 and an outer cover 23, 33, 43, 53. The mounting panel 21, 31, 41, 51 has at least two mounting holes 211, 311, 411, 511 separately formed through the mounting panel 21, 31, 41, 51. The outer cover 23, 33, 43, 53 corresponds to and is securely mounted on the mounting panel 21, 31, 41, 51.

The at least two conductive sheets 212, 312, 412, 512 are mounted in the housing, are mounted on the mounting panel 21, 31, 41, 51 of the housing, respectively correspond to the mounting holes 211, 311, 411, 511 of the mounting panel 21, 31, 41, 51, protrude out from a bottom of the housing and are selectively and electrically connected respectively to the at least two conductive connectors 114 of the base 10. Each of the at least two conductive sheets 212, 312, 412, 512 has a conductive portion protruding through a corresponding mounting hole 211, 311, 411, 511 of the mounting panel 21, 31, 41, 51 and electrically connected to a corresponding conductive connector 114 of the base 10.

The at least two prongs 22, 32, 42, 52 are mounted through the outer cover 23, 33, 43, 53 of the housing and are respectively connected to the at least two conductive sheets 212, 312, 412, 512. Each of the at least two prongs 22, 32, 42, 52 has an outer end and an inner end. The outer end of the prong 22, 32, 42, 52 protrudes out of the outer cover 23, 33, 43, 53 of the housing. The inner end of the prong 22, 32, 42, 52 is electrically connected to a corresponding conductive sheet 212, 312, 412, 512.

The second connecting component 24, 34, 44, 54 is cylindrical and hollow, is disposed on the bottom of the housing, is disposed around the mounting holes 211, 311, 411, 511 of the mounting panel 21, 31, 41, 51, is detachably connected to the first connecting component 11 of the base 10 and has an outer peripheral surface, a peripheral end edge and at least one positioning groove 241, 341, 441, 541. The at least one positioning groove 241, 341, 441, 541 is formed in the outer peripheral surface of the second connecting component 24, 34, 44, 54 and selectively engages the at least one positioning protrusion 113 of the first connecting component 11. Each of the at least one positioning groove 241, 341, 441, 541 has an inserting portion 2411 and a holding portion 2412. The inserting portion 2411 is longitudinally formed in the outer peripheral surface of the second connecting component 24, 34, 44, 54 and through the peripheral end edge of the second connecting component 24, 34, 44, 54. The holding portion 2412 is transversely formed in the outer peripheral surface of the second connecting component 24, 34, 44, 54 and communicates with the inserting portion 2411.

When connecting the adapter 20, 30, 40, 50 to the base 10, each of the at least one positioning protrusion 113 of the first connecting component 11 slides into the inserting portion 2411 of a corresponding positioning groove 241, 341, 441, 541 and then the base 10 and the adapter 20 are rotated respectively to allow the positioning protrusion 113 to slide in the holding portion 2412 of the corresponding positioning groove 241, 341, 441, 541. Thus, the conductive sheets 212, 312, 412, 512 are respectively connected electrically to the conductive connectors 114.

The power supply 102 is disposed on a bottom of the base 10 and is electrically connected to the transformer circuit 101 of the base 10. The power supply 102 may be a power cord. The power cord is mounted on the bottom of the base 10, is electrically connected to the transformer circuit 101 of the base 10 and is selectively connected to an electronic device, such as an electric appliance, a battery charger, a transformer and the like, to charge the electronic device. The power supply may have a Universal Serial Bus (USB) socket and an external cable 60. The USB socket is mounted in the bottom of the base 10 and is electrically connected to the transformer circuit 101 of the base 10. The external cable 60 is Y-shaped and has a USB plug 61 and two USB receptacles 62. The USB plug 61 is selectively inserted into the USB socket and is electrically connected to the transformer circuit 101 of the base 10. The USB receptacles 62 are selectively connected to the electronic devices to charge the electronic devices.

With reference to FIGS. 4 to 7, a first embodiment of the adapter 20 is for use in the USA, Japan and China. The mounting panel 21 of the housing of the adapter 20 is substantially rectangular and has two mounting holes 211. Correspondingly, the outer cover 23 of the housing of the adapter 20 is substantially rectangular. The adapter 20 has two conductive sheets 212 and two prongs 22 and further has a prong mount 213 and a connecting rod 221. The conductive sheets 212 respectively correspond to the mounting holes 211 of the mounting panel 21. The prongs 22 are flat, parallel to each other and non-coplanar. The prong mount 213 is mounted on the mounting panel 21 and is disposed between the mounting holes 211 of the mounting panel 21. The connecting rod 221 is mounted on the prong mount 213 and has two ends respectively connected to the prongs 22.

With reference to FIGS. 8 to 11, a second embodiment of the adapter 30 is for use in Australia. The mounting panel 31 of the housing of the adapter 30 has two mounting holes 311. The outer cover 33 of the housing of the adapter 30 has two prong holes 331 formed through the outer cover 33. The adapter 30 has two conductive sheets 312 and two prongs 32. The conductive sheets 312 respectively correspond to the mounting holes 311 of the mounting panel 31. The prongs 32 are flat, are respectively mounted through the prong holes 331 of the outer cover 33, are respectively connected to the conductive sheets 312 and are disposed unparallel to each other and in an upside down V-shaped form.

With reference to FIGS. 12 to 15, a third embodiment of the adapter 40 is for use in continental Europe and most of the Middle East countries. The mounting panel 41 of the housing of the adapter 40 has two mounting holes 411. The outer cover 43 of the housing of the adapter 40 has two prong holes 431 and a fastening hole 432. The prong holes 431 are separately formed through the outer cover 43. The fastening hole 432 is formed in an inner surface of the outer cover 43 and is disposed between the prong holes 431. The adapter 40 has two conductive sheets 412 and two prongs 42 and further has a prong mount 421 and a fastener 423. The conductive sheets 412 respectively correspond to the mounting holes 411 of the mounting panel 41. The prong mount 421 is mounted in the housing of the adapter 40, is disposed between the mounting holes 411 of the mounting panel 41 and has a countersink 422 formed through the prong mount 421 and corresponding to the fastening hole 432 of the outer cover 43. The prongs 42 are securely mounted through the prong mount 421 and are respectively mounted through the prong holes 431 of the outer cover 43. Each prong 42 is rounded in cross-section. The inner end of each prong 42 is connected to the corresponding conductive sheet 412. The outer end of each prong 42 protrudes out of the outer cover 43.

With reference to FIGS. 16 to 19, a fourth embodiment of the adapter 50 is for use in the United Kingdom. The mounting panel 51 of the housing of the adapter 50 has two mounting holes 511. The outer cover 53 of the housing of the adapter 50 has two prong holes 531 formed through the outer cover 53. The adapter 50 has two conductive sheets 512 and three prongs 52. The conductive sheets 512 respectively correspond to the mounting holes 511 of the mounting panel 51. The prongs 52 are disposed in a triangular form. One of the prongs 52 is securely mounted on the outer cover 53 and is used for grounding. The other two of the prongs 52 are respectively mounted through the prong holes 531 of the outer cover 53 and are respectively connected to the conductive sheets 512. Each of the prongs 52 is rectangular in cross-section.

The plug device with the changeable adapter as described has the following advantages. Since the adapter 20, 30, 40, 50 is detachable, when a user goes on a trip abroad, the user is capable of replacing the adapter to fit sockets of a specific country and to supply electrical power to electronic devices that the user carries along.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A plug device comprising:

a base having a transformer circuit mounted in the base;

a first connecting component disposed on a top of the base and having a mounting recess formed in a top of the first connecting component;

an inner peripheral surface defined around the mounting recess;

a bottom defined in the mounting recess; and at least one positioning protrusion formed on the inner peripheral surface and spaced out from the bottom; and at least two conductive connectors slidably mounted through the bottom of the first connecting component and electrically connected to the transformer circuit; and an adapter detachably mounted on the base and having a housing having a mounting panel having at least two mounting holes separately formed through the mounting panel; and an outer cover corresponding to and securely mounted on the mounting panel;

at least two conductive sheets mounted on the mounting panel of the housing, respectively corresponding to the at least two mounting holes of the mounting panel, protruding out from a bottom of the housing and selectively and electrically connected respectively to the at least two conductive connectors of the base, and each of the at least two conductive sheets having a conductive portion protruding through a corresponding mounting hole of the mounting panel and electrically connected to a corresponding conductive connector of the base;

at least two prongs mounted through the housing and respectively connected to the at least two conductive sheets; and a second connecting component being cylindrical and hollow, disposed on the bottom of the housing, disposed around the mounting holes of the mounting panel, detachably connected to the first connecting component of the base and having an outer peripheral surface;

a peripheral end edge; and at least one positioning groove formed in the outer peripheral surface of the second connecting component and selectively engaging the at least one positioning protrusion of the first connecting component, and each of the at least one positioning groove having an inserting portion longitudinally formed in the outer peripheral surface of the second connecting component and through the peripheral end edge of the second connecting component; and a holding portion transversely formed in the outer peripheral surface of the second connecting component and communicating with the inserting portion.

2. The plug device as claimed in claim 1, wherein the base further has an inner cover mounted on the top of the base; and at least two conductive resilient elements mounted through the inner cover and electrically connected to the transformer circuit of the base;

the first connecting component is disposed over the inner cover; and the at least two conductive connectors respectively abut the at least two conductive resilient elements and are electrically connected to the transformer circuit through the at least, two conductive resilient elements.

3. The plug device as claimed in claim 2, wherein each of the at least two conductive connector is tubular and has an open end corresponding to the inner cover; and a closed end; and the at least two conductive resilient elements are respectively mounted in the at least two conductive connectors and abut the closed end of the at least two conductive connectors.

4. The plug device as claimed in claim 3, wherein the adapter has two prongs, and each prong has an outer end protruding out of the housing of the adapter; and an inner end electrically connected to a corresponding conductive sheet.

5. The plug device as claimed in claim 1 further comprising a Universal Serial Bus (USB) socket mounted in a bottom of the base and electrically connected to the transformer circuit of the base.

6. The plug device as claimed in claim 2 further comprising a USB socket mounted in a bottom of the base and electrically connected to the transformer circuit of the base.

7. The plug device as claimed in claim 3 further comprising a USB socket mounted in a bottom of the base and electrically connected to the transformer circuit of the base.

8. The plug device as claimed in claim 4 further comprising a USB socket mounted in a bottom of the base and electrically connected to the transformer circuit of the base.

9. The plug device as claimed in claim 4 further comprising an external cable being Y-shaped and having a USB plug selectively inserted into the USB socket; and two USB receptacles.

10. The plug device as claimed in claim 6 further comprising an external cable being Y-shaped and having a USB plug selectively inserted into the USB socket; and two USB receptacles.

11. The plug device as claimed in claim 7 further comprising an external cable being Y-shaped and having a USB plug selectively inserted into the USB socket; and two USB receptacles.

12. The plug device as claimed in claim 8 further comprising an external cable being Y-shaped and having a USB plug selectively inserted into the USB socket; and two USB receptacles.

* * * * *